US006854905B2

(12) United States Patent
Hardisty et al.

(10) Patent No.: US 6,854,905 B2
(45) **Date of Patent: *Feb. 15, 2005**

(54) STATIONARY MEDIA MOBILE PRINTING

(75) Inventors: Jaime S. Hardisty, Albany, OR (US); Mackenzie Williams, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/615,862

(22) Filed: Jul. 9, 2003

(65) Prior Publication Data

US 2004/0009024 A1 Jan. 15, 2004

Related U.S. Application Data

(63) Continuation of application No. 09/967,071, filed on Sep. 28, 2001, now Pat. No. 6,648,528.

(51) Int. Cl.[7] ..... B41J 2/01

(52) U.S. Cl. ..... 400/323; 400/88; 400/139; 400/320; 347/37; 347/86

(58) Field of Search ..... 400/323, 320, 400/139, 88, 86, 319; 347/37, 86

(56) References Cited

U.S. PATENT DOCUMENTS

| | | | | | |
|---|---|---|---|---|---|
| 4,545,695 | A | * | 10/1985 | Agata | 400/320 |
| 4,700,238 | A | * | 10/1987 | Sugiyama | 358/300 |
| 5,012,353 | A | * | 4/1991 | Yoshino et al. | 358/401 |
| 5,063,451 | A | * | 11/1991 | Yanagisawa et al. | 346/143 |
| 5,685,651 | A | * | 11/1997 | Hayman et al. | 400/88 |
| 5,793,392 | A | * | 8/1998 | Tschida | 347/40 |
| 5,856,833 | A | * | 1/1999 | Elgee et al. | 347/19 |
| 6,674,543 | B2 | * | 1/2004 | Day et al. | 358/1.8 |

* cited by examiner

*Primary Examiner*—Andrew H. Hirshfeld
*Assistant Examiner*—Dave A. Ghatt

(57) ABSTRACT

A portable printer includes a top cover, a bottom cover, one or more rail units located on the inside surface of the top cover, and a carriage assembly. Media is positionable on the inside surface of the bottom cover. The carriage assembly is movably connected to the rail units, such that the carriage assembly is able to move at least one of horizontally and vertically over the media, and print on substantially any part of the media, wherein the media is capable of being stationary during printing.

20 Claims, 10 Drawing Sheets

STATIONARY MEDIA MOBILE PRINTING

This application is a continuation of Ser. No. 09/967,071 filed on Sep. 28, 2001 and now U.S. Pat No. 6,648,528.

FIELD OF THE INVENTION

This invention relates generally to printers for computers, and more particularly to such printers that are mobile in nature.

BACKGROUND OF THE INVENTION

Mobile computers, commonly called notebook or laptop computers, have become increasingly popular. Whereas desktop computers force their users to work at only a single location, laptop computers allow their users greater freedom in where the users can work. Users can, for instance, bring their laptop computers home from work and back again, and can also work on them in airplanes, trains, and otherwise while traveling.

As notebook computers have become more powerful, approaching that of their desktop counterparts, users have begun to expect the same peripherals that they use with their desktop computers. For example, many notebook computers come equipped with DVD, CD-ROM, and other types of drives, enabling their users to play movies and install software off optical media no different than if they were using desktop computers. With the advent of wireless networking, both wireless wide-area networking (WAN) and wireless local-area networking (LAN), users can even access network resources across broad areas when using their laptop computers.

One common peripheral that users enjoy having access to is the printer, which enables them to print hardcopies of documents that they may be working on with their laptop computers. Mobile printers, however, have not advanced to the same degree as laptop computers have. Although mobile printers are frequently smaller than their non-mobile counterparts, they are still overly complex, bulky, orientation sensitive, and power hungry. Their added weight means that users may think twice before bringing them along on a trip. Their general inability to run for extended periods off battery power means that users may not be able to use them as conveniently as they can their laptop computers.

In many instances, mobile printers do not represent a rethinking of how a printer functions, but rather only a miniaturization of the innards of a more conventional printer. A common printing technology used in mobile printers is inkjet technology. An inkjet printer is a printer that places extremely small droplets of ink onto paper to create an image. Other types of printers include dot matrix printers, laser printers, and printers that use solid ink, dye sublimation, thermal wax, and thermal autochrome technologies. However, inkjet technology is most popular for mobile printing applications, perhaps because of its relatively low cost, ability to print in different colors, and ability to have its components miniaturized, among other reasons.

A typical inkjet printer, be it a desktop or a mobile printer, usually has a number of common components, regardless of its brand, speed, and so on. There is a print head that contains a series of nozzles used to spray drops of ink onto paper. Ink cartridges, either integrated into the print head or separate therefrom, supply the ink. There may be separate black and color cartridges, color and black in a single cartridge, or cartridges for each ink color. A print head stepper motor typically moves the print head assembly back and forth horizontally, or laterally, across the paper, where a belt is used to attach the assembly to the motor. The assembly may use a stabilizer bar to ensure that print head movement is precise and controlled. Rollers pull paper from a tray, feeder, or the user's manual input, and advance the paper to new vertical locations on the paper.

The significant difference in existing mobile inkjet printers from desktop inkjet printers, then, is in the size of their components, which allows the mobile printers to be more transportable. The print head may be smaller, which enables a smaller and less powerful motor to be used to horizontally move the print head across the paper. There may not be a dedicated tray or paper feeder to supply paper to the print head, the printer instead relying on the user to feed the paper to the rollers to push or pull through the printer. The vast majority of mobile printers still rely on rollers to allow the printer to print on different vertically oriented regions of the paper, with the print head itself moving horizontally to print on different horizontally oriented regions of the paper.

However, the paper-feed mechanism of printers in general likely prevents this miniaturization from continuing to the point where an optimal mobile printer is designed. Merely decreasing the size of printer components to essentially turn a desktop printer into a mobile printer likely does not result in a mobile printer that is as small, lightweight, and able to run off batteries as it could be. For these and other reasons, therefore, there is a need for the present invention.

SUMMARY OF THE INVENTION

In one embodiment, a portable printer includes a top cover, a bottom cover, one or more rail units located on the inside surface of the top cover, and a carriage assembly. Media is positionable on the inside surface of the bottom cover. The carriage assembly is movably connected to the rail units, such that the carriage assembly is able to move at least one of horizontally and vertically over the media, and print on substantially any part of the media, wherein the media is capable of being stationary during printing.

Still other embodiments, aspects, and of the invention will become apparent by reading the detailed description that follows, and by referring to the accompanying drawings.

DETAILED DESCRIPTION OF THE INVENTION

In the following detailed description of exemplary embodiments of the invention, reference is made to the accompanying drawings that form a part hereof, and in which is shown by way of illustration specific, exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Interaction Between Mobile Printer and Docking Station

Figure 1:
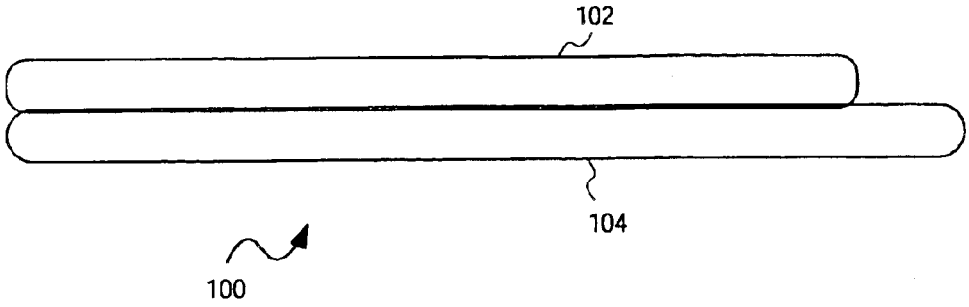
FIG. 1 is a diagram showing a side view of a printer and an associated docking station according to an embodiment of the invention.

FIG. 1 shows a side view of a system 100 including a portable printer 102 and a docking station 104 according to an embodiment of the invention. The printer 102 is substantially flat and thin, and can be only 800 mills thick. The printer 102 removably connects to the docking station 104, such as via bayonet-style connectors for electrical connection and mechanical positioning. The docking station 104 may be, for instance, the same docking station available for use with the OMNIBOOK 500 notebook computer, available from Hewlett-Packard Co., of Palo Alto, Calif. The docking station houses between one and three conventional laptop computer batteries, which in this instance are used to power the printer 102. The docking station 104 may alternatively be an expansion base that is used with different types of notebook computers.

Figure 2:
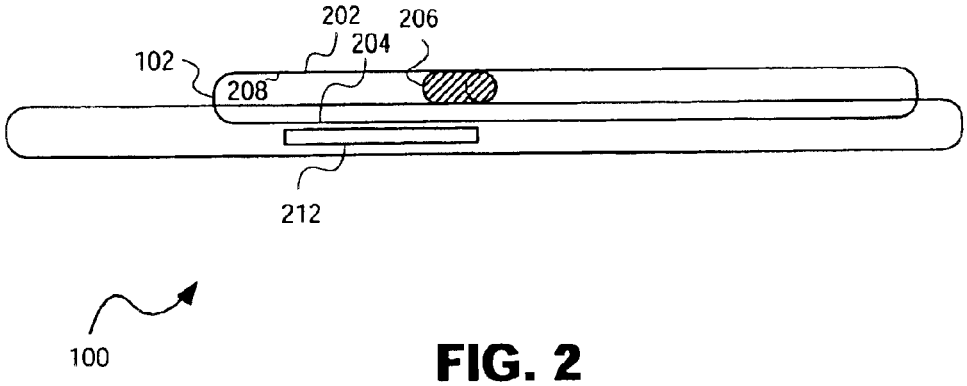
FIG. 2 is a diagram showing a cutaway side view of a printer and an associated docking station according to an embodiment of the invention.

FIG. 2 shows a cutaway side view of the system 100. The portable printer 102 includes a top cover 202 and a, bottom cover 204. A carriage assembly 206 is removably connected to the top cover 202 via one or more rail units 208 on the inside surface of the top cover 202, whereas a media 210 may be positioned in a stationary manner on the inside surface of the bottom cover 204. The invention is also applicable to any media, and not just paper. A slot 212 accepts a connector hardware card so that the printer 102 is able to communicate with a host computer, such as a laptop computer, which is not specifically shown in FIG. 2. The slot 212 may be, for instance, a PC Card slot that accepts PC Cards, which are also known as PCMCIA cards. Furthermore, the slot 212 generally encompasses all such approaches by which the printer 102 is able to communicate with the printer, such as any other type of wired communication, as well as wireless communication.

Horizontal and Vertical Motion of Carriage Assembly

Figure 3:
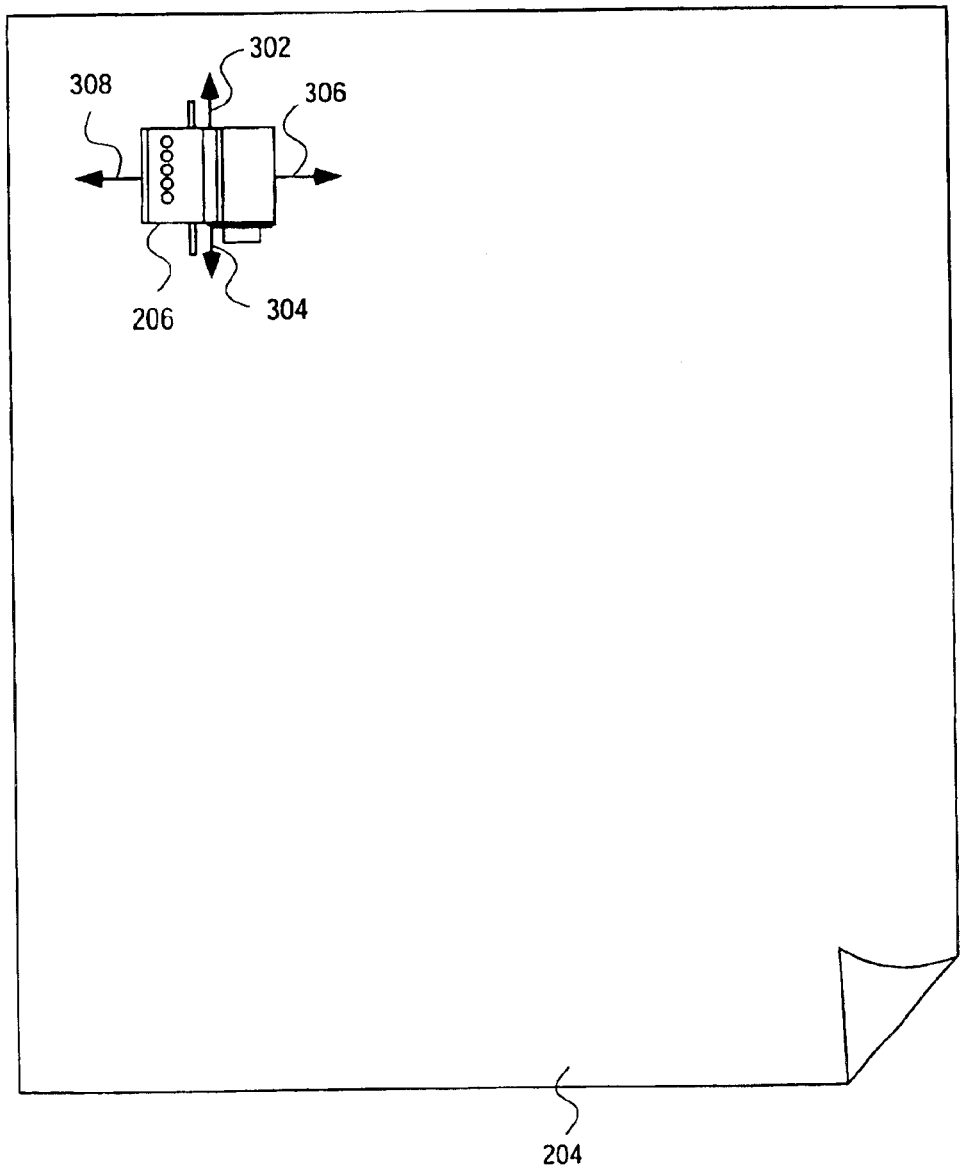
FIG. 3 is a diagram showing how the carriage assembly of a printer is able to move both vertically and horizontally across a stationary media, according to an embodiment of the invention.

FIG. 3 shows how the carriage assembly 206 is able to move both horizontally and vertically across the media 204, without the need for rollers or a feeder to push or pull the media. Specifically, the carriage assembly 206 is able to move vertically both in the up direction 302 and the down direction 304. The carriage assembly 206 is also able to move horizontally both in the right direction 306 and the left direction 308. The carriage assembly 206 achieves this horizontal and vertical motion via removable connection to the rail units 208, which are not specifically shown in FIG. 3.

Figure 4A:
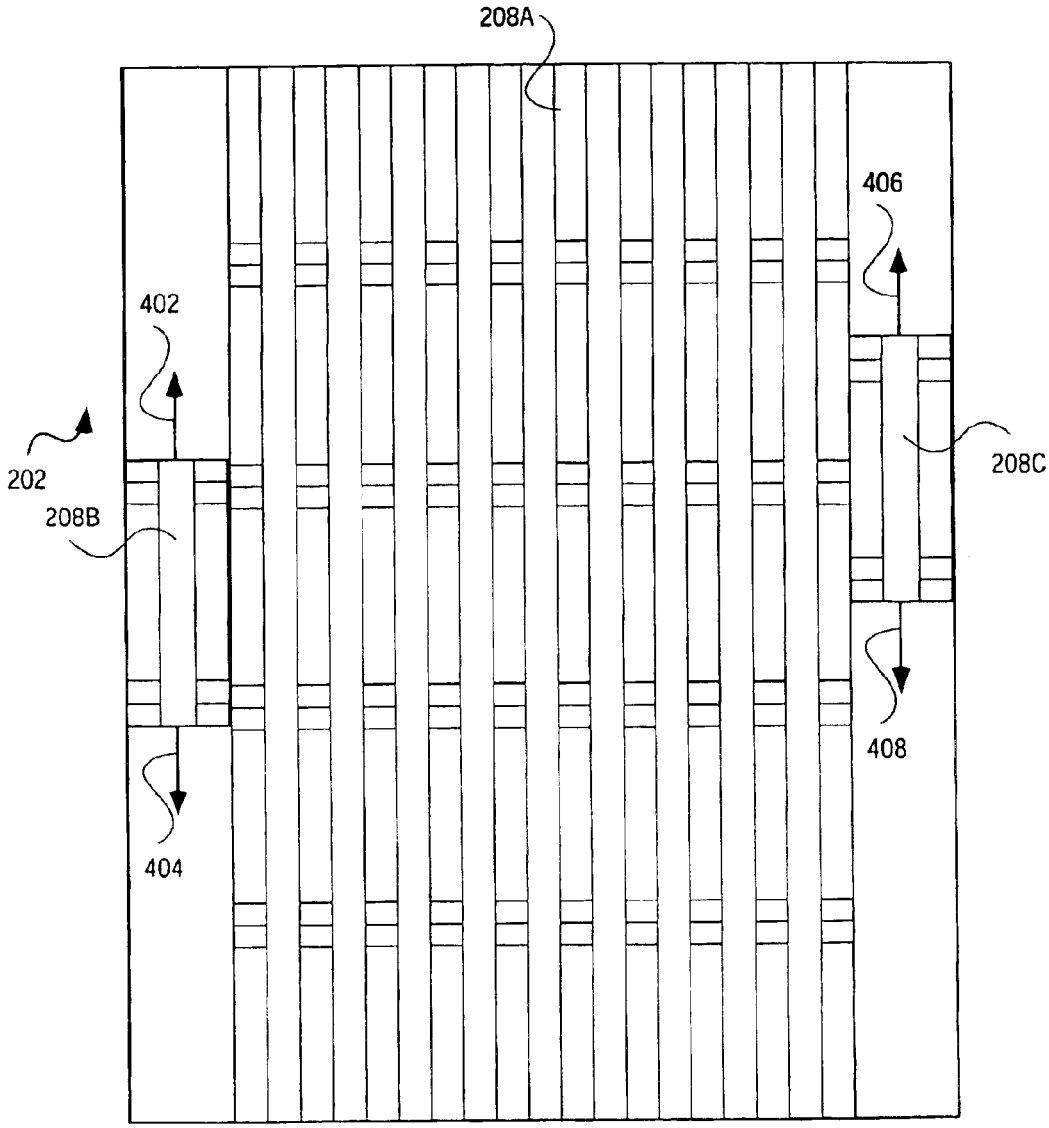
FIG. 4A is a diagram showing an embodiment of the invention in which a fixed rail unit and two mobile rail units enable two-dimensional movement of the carriage assembly.
Figure 4B:
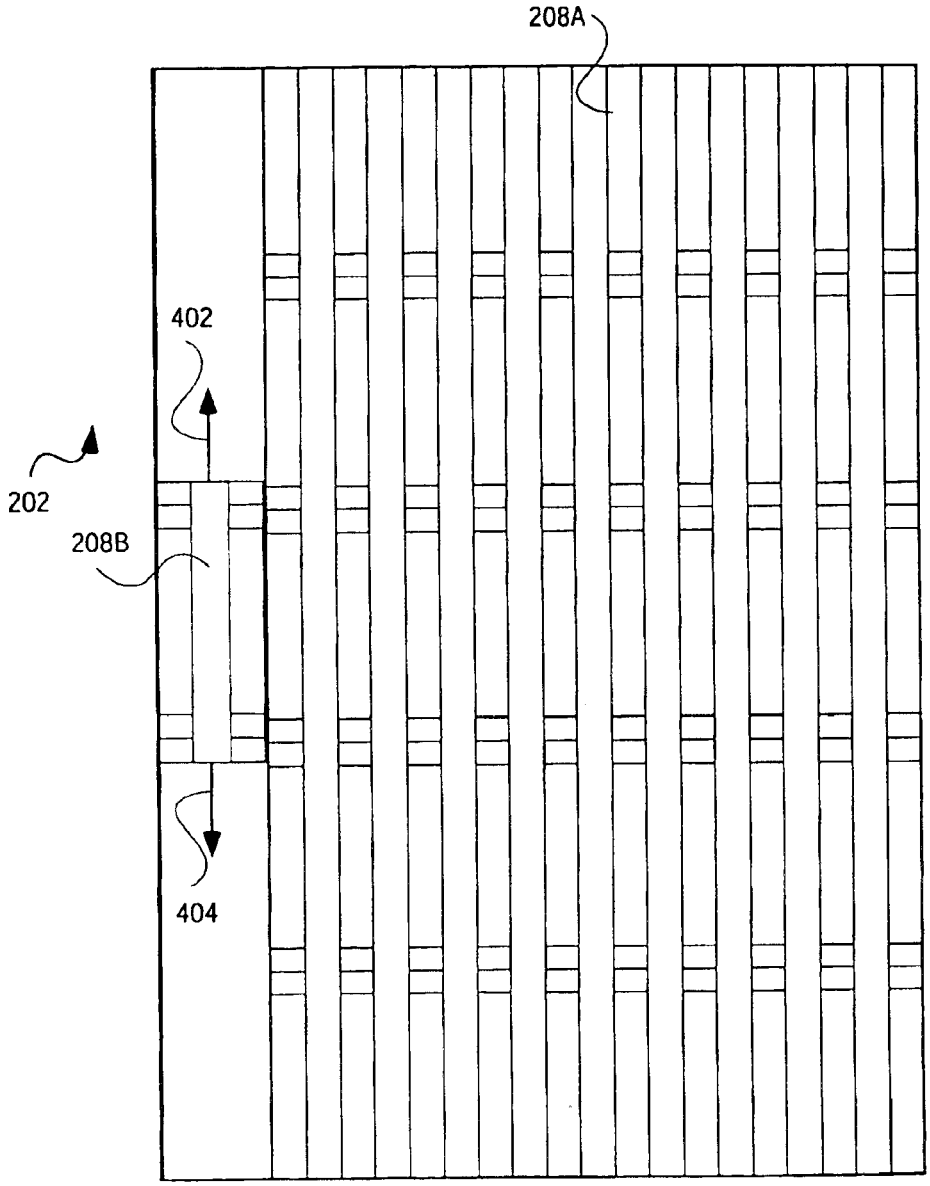
FIG. 4B is a diagram showing an embodiment of the invention in which a fixed rail unit and one mobile rail unit enable two-dimensional movement of the carriage assembly.
Figure 4C:
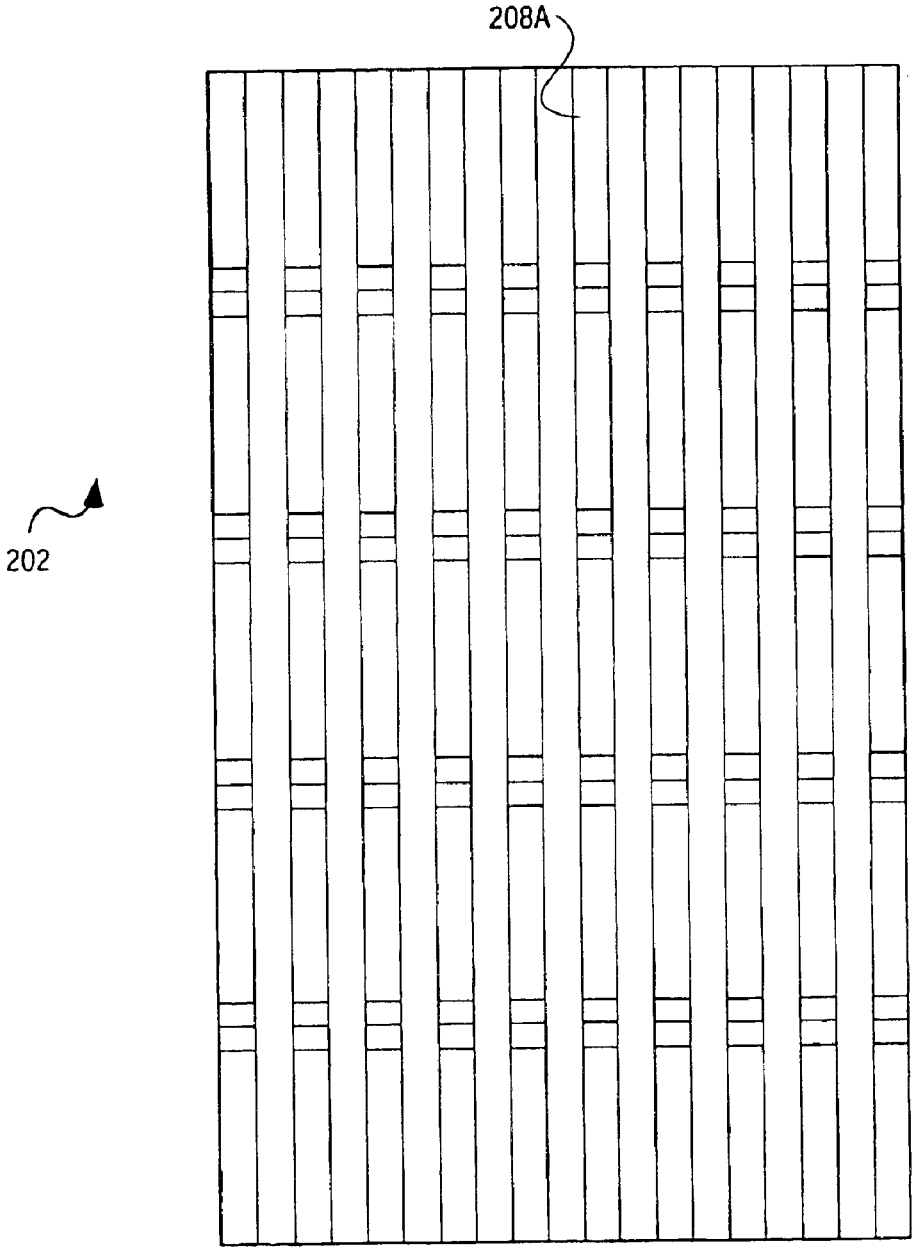
FIG. 4C is a diagram showing an embodiment of the invention in which a single fixed rail unit enables two-dimensional movement of the carriage assembly.

FIGS. 4A, 4B, and 4C show how differing embodiments of the invention use differing numbers of rail units 208 to achieve horizontal and vertical motion of the carriage assembly 206. In FIG. 4A, a fixed rail unit 208A is mounted to the inside surface of the top cover 202 of the portable printer 102. The rail unit 208A desirably extends from the top side to the bottom side of the top cover 202, and extends from one-and-a-half inches from the left side to one-and-a-half inches from the right side of the top cover 202. The rail units 208B and 208C are conversely not fixed, but rather each can move vertically. For instance, the movable rail unit 208B moves vertically in the up direction 402 and the down direction 404, whereas the movable rail unit 208C moves vertically in the up direction 406 and the down direction 408.

The carriage assembly 206, not specifically shown in FIG. 4A, moves horizontally substantially via the fixed rail unit 208A. Conversely, the assembly 206 moves vertically substantially via the rail units 208B and 208C. More specifically, to move vertically, the assembly 206 is positioned over either the rail unit 208B or the rail unit 208C, which enables it to move down or up, so that it can then again move horizontally over the fixed rail unit 208A. As an example, the assembly 206 may start in the upper-left hand comer on the rail unit 208B, and then move horizontally left to right across the rail unit 208A to the rail unit 208C, which transports the assembly 206 vertically down. The assembly 206 then is able to move in the opposite direction horizontally, right to left, across the rail unit 208A, to the rail unit 208C, which also transports the assembly 206 vertically down. This process continues until the assembly 206 has proceeded over substantially the entire media 204, not specifically shown in FIG. 4A, as necessary.

FIG. 4B shows an alternative embodiment of the invention in which there is only a single movable rail unit 2088, such that there is no movable rail unit 208C, as there is in the embodiment of FIG. 4C. The movable rail unit 208B is able to move vertically in the up direction 402 and the down direction 404, whereas the rail unit 208A is still fixed to the inside surface of the top cover 202. In this embodiment, the carriage assembly 206 moves horizontally from a starting position in the upper left hand corner on the rail unit 208B, across the fixed rail unit 208A, left to right. The carriage assembly 206 then moves back to the rail unit 208B across the fixed rail unit 208A, right to left, where it is moved vertically via the rail unit 208B, such that the process continues as necessary.

FIG. 4C shows another alternative embodiment in which there is only the fixed rail unit 208A mounted to the inside surface of the inside cover 202. That is, there are no movable rail units, such as the movable rail unit 208B of the embodiment of FIG. 4B, or the movable rail units 208B and 208C of the embodiment of FIG. 4A. In this embodiment, the carriage assembly 206 moves horizontally substantially via the fixed rail unit 208A, and moves vertically by jumping, or "bumping," down to another part of the fixed rail unit 208A. The embodiment of FIG. 4C has one advantage over the embodiments of FIGS. 4A and 4B in that it has less moving parts, specifically in that the embodiment of FIG. 4C does not have the movable rail unit(s) 208B and/or 208C.

Figure 5:
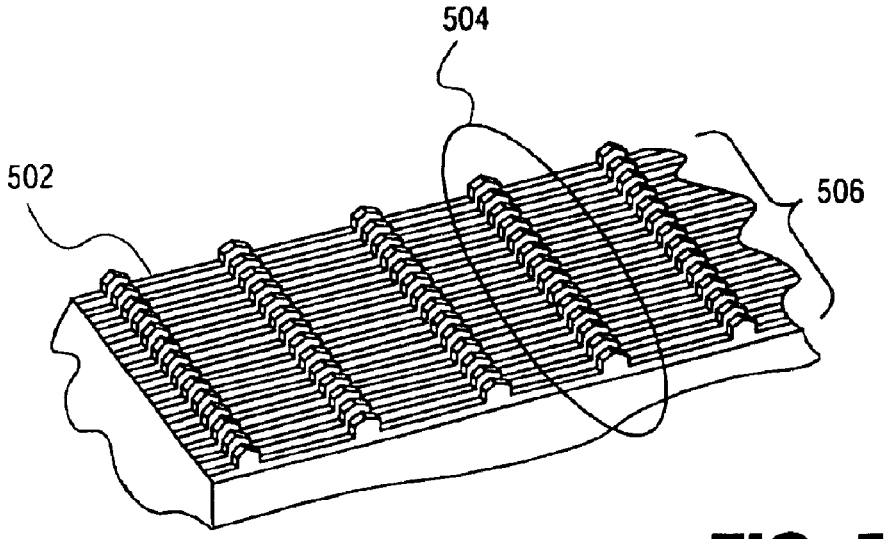
FIG. 5 is a diagram showing a perspective view of the rail units of FIGS. 4A, 4B, and 4C, according to an embodiment of the invention.

FIG. 5 shows a perspective view of an example rail unit 502, that can function as any of the rail units 208A, 208B, and 208C of FIGS. 4A, 4B, and/or 4C. The rail unit has fixed gear teeth, such as the row of fixed gear teeth 504, and can be at a pitch of fifteen threads per inch. The gear teeth can have an angle compatible with a 500 mil diameter worm gear, where a motor having such a gear is the part of the carriage assembly 206 enabling horizontal movement of the assembly 206 across the rail unit 502. Rails 506 can be mounted to the toothed area at a 330 mil pitch, which is the print swath, generally defined as the area printed by a print head of the carriage assembly 206 at one time. The rails have teeth on top to engage the worm gear, and have slots on the side to which the carriage assembly 206 removably connects. Where the rail unit 502 is a movable rail unit, the rail unit is able to slide one rail pitch perpendicular to the fixed rails, and are kept aligned to the fixed rails by one wire leaf spring, relocking the movable rails with the fixed rails until the carriage assembly 206 is fully inserted into the fixed rails. The rail unit 502 may be fabricated from a long-life and high-wear material, such as dense polymer, or metal-coated polymer.

Figure 6:
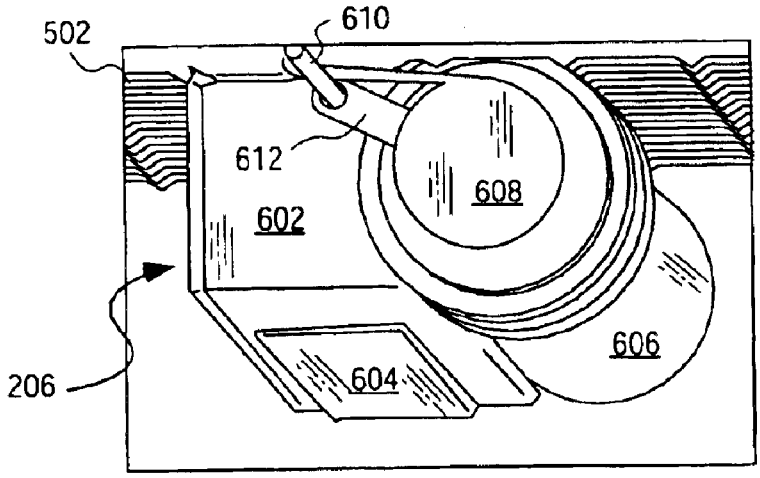
FIG. 6 is a diagram showing a carriage assembly according to an embodiment of the invention.

FIG. 6 shows a side view of the carriage assembly 206 in more detail, detailing the parts of the assembly 206 that enable it to move vertically on a movable rail unit and horizontally on any type of rail unit. The carriage assembly 206 includes a carriage unit 602, a print head 604 on the bottom surface of the carriage unit 602, worm-gear motor 606, a watch-spring catch 608, and a drag-engage mechanism 610 that has a member 612 connecting it to the motor 606. All of these components are self-contained within the carriage assembly 206 itself. The print head 604 is desirably an inkjet-type print head, but may also be a thermal-type print head, or another type of print head. An inkjet-type print head is more generally referred to as a fluid-type print head. The carriage assembly 206 moves horizontally on the rail unit 502 via the worm-gear motor 606. The motor 606 is desirably one-inch long by 450 mills in diameter, connected to a worm gear of fifteen threads per inch, one-half inch in diameter, and 250 mills wide. Alternatively the motor 606 may be a stepper motor, a hall-effect motor, or another type of motor.

When horizontally moving, the carriage assembly 206 approaches either the left or right side of the portable printer 102. In so doing, the drag-engage mechanism 610 ultimately presses against the side of the printer 102, which causes it to be pushed in, winding the watch-spring catch 608. This stores energy in the watch-spring catch 608, such that when the mechanism 610 is completely pushed in—coinciding with the movement of the assembly 206 completely over a movable rail unit—the energy is released, causing the assembly 206 to move the movable rail unit on which it is located up or down vertically. A trip mechanism, specifically not shown in FIG. 6, can further be used so that the movable rail unit is forced to switch directions vertically, from the up direction to the down direction, or vice-versa. The watch-spring catch 608 thus powers and sets direction for vertical movement of the movable rail unit and thus the assembly 206 itself.

Figure 7:
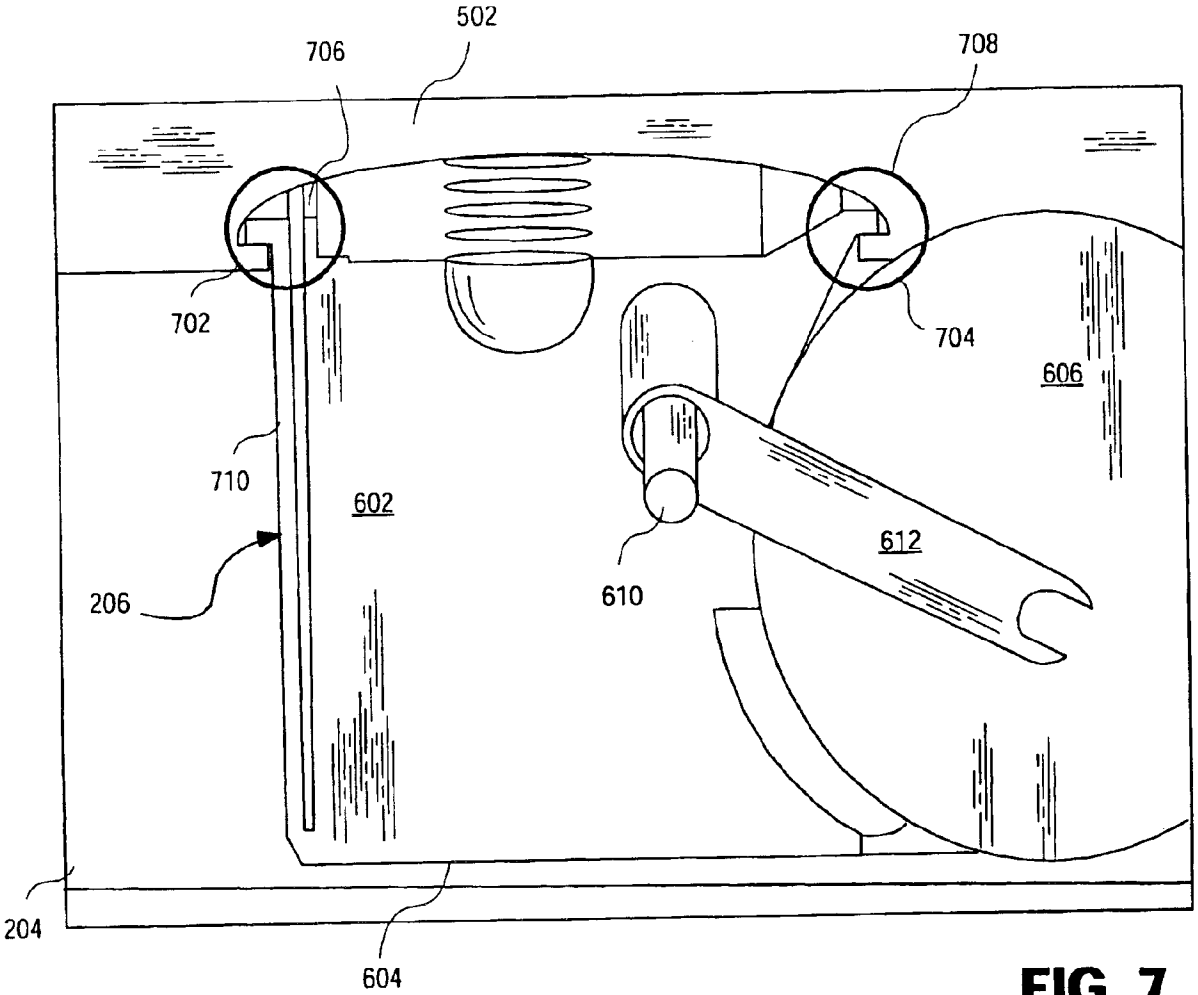
FIG. 7 is a diagram showing in detail how the carriage assembly of FIG. 6 engages with the rail units of FIG. 5, according to an embodiment of the invention.

FIG. 7 shows in detail how the carriage assembly 206 engages with the gear teeth of a rail unit, such as the rail unit 502. In particular, as indicated by the circles 702 and 704, the assembly 206 has slots 706 and 708 that engage the rail unit 502. The carriage assembly 206 also has a release lever 710, that, when pressed by the user, allows the user to remove the carriage assembly 206 from the rail unit 502. Disengagement and removal of the assembly 206 is desirable so that the user can replace the print head 604 of the assembly 206, or perform other types of maintenance on the assembly 206.

The carriage assembly 206 as shown in FIGS. 6 and 7 is particularly used in the embodiments of FIGS. 4A and 4B, where there is one or two movable rail units 208A and/or 208B in addition to the fixed rail unit 208A. In the embodiment of FIG. 4C, the carriage assembly 206 alternatively can include a solenoid, using a latch with one spring to hold the assembly 206 in place. Asserting the solenoid in this instance causes the carriage assembly 206 not to be held in position, such that it can then jump to the next vertical position.

Fluid Capsules Within Wells of Carriage Assembly

Figure 8:
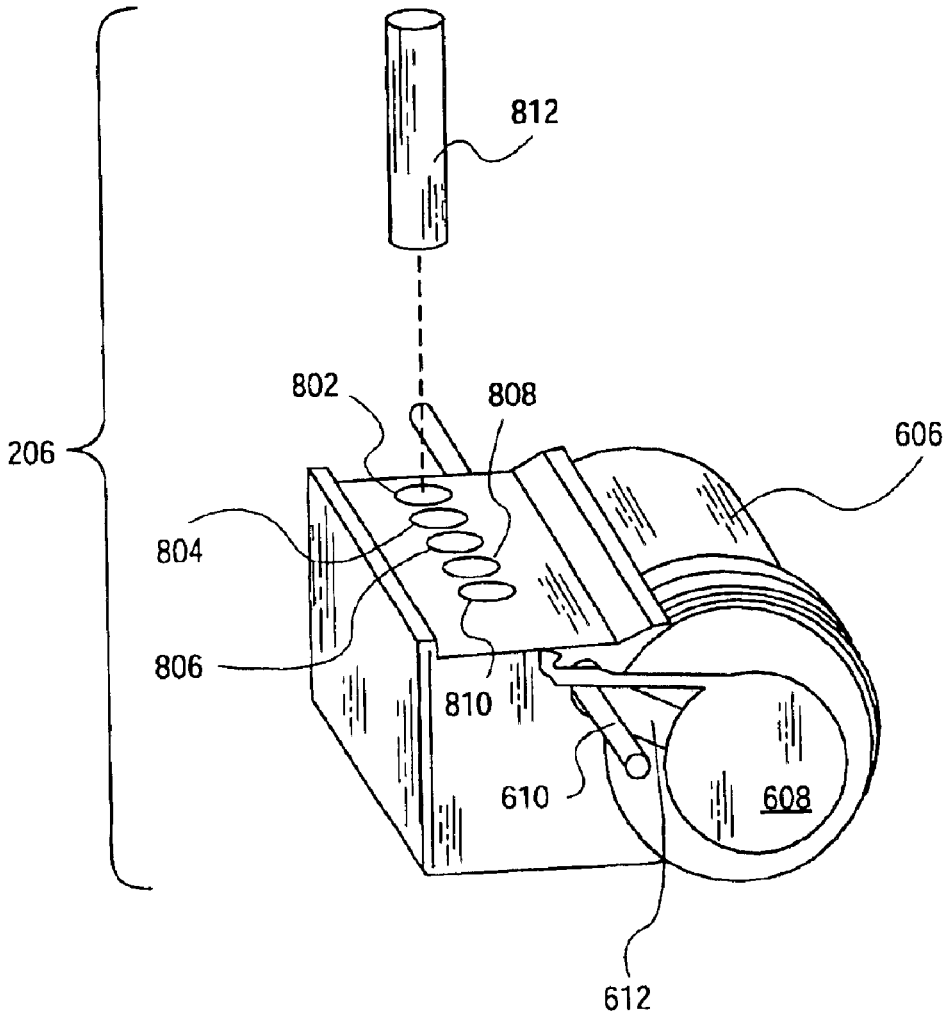
FIG. 8 is a diagram showing how a carriage assembly accepts fluid capsules according to an embodiment of the invention.

FIG. 8 shows how fluid capsules fit into wells of the carriage assembly 206. The components of the carriage assembly 206 still include the carriage 602, the motor 606, the watch-spring catch 608, and the drag-engage mechanism 610 with the member 612. The carriage 602 has on its top surface a number of wells 802, 804, 808, and 810. The diameter of each well may be about 370 mils. There may be a well for each fluid color needed, such as yellow, blue, and red, as well as one or more wells for black fluid. There may also be a well for each of two tones of red fluid, and two tones of blue fluid in some embodiments. As shown in FIG. 8, a fluid capsule 812 is being inserted specifically into the well 802. The inside surface of each well preferably has a sharp edge that cuts a fluid capsule open when it is inserted into the well.

The fluid capsule 812 is specifically shown as having a cylindrical shape, such as a cylinder 370 mils in diameter with a 440 mil diameter rim for ease of manual extraction. Alternatively, the fluid capsule 812 may have a triangular, octagonal, or another shape. Each fluid capsule may have the same shape, or they may have different shapes. Each fluid capsule may hold 0.6 milliliters of fluid. The fluid contained in each capsule may be in liquid form, known as free-fluid supply, which provides the print head 604 (not specifically shown in FIG. 8) with substantially 0.25 inches of head pressure. Alternatively, the fluid may be contained in each capsule with a large cell-foam media inside the capsule. There are typically zero inches of back pressure within each capsule.

Figure 9:
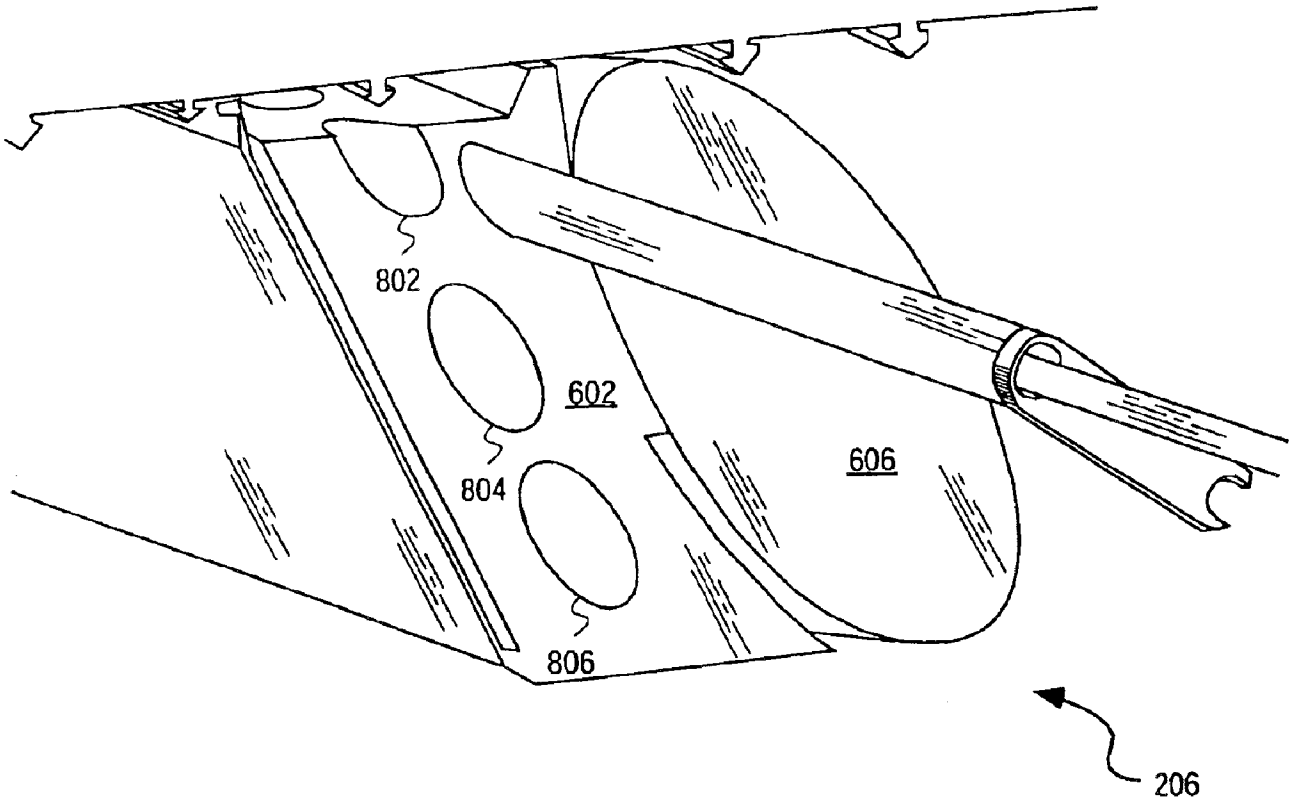
FIG. 9 is a diagram showing in detail the wells of the carriage assembly of FIG. 8 that accept fluid capsules, according to an embodiment of the invention.

FIG. 9 shows a top view of the carriage assembly 206 depicting three of the wells 802, 804, and 806 in more detail. The wells 802, 804, and 806 are shown in FIG. 9 as having a circular cross-section. The carriage assembly 206 is further shown as engaged with the rail unit 208 attached to the inside surface of the top cover 202.

Maintenance Package for Portable Printer

Figure 10:
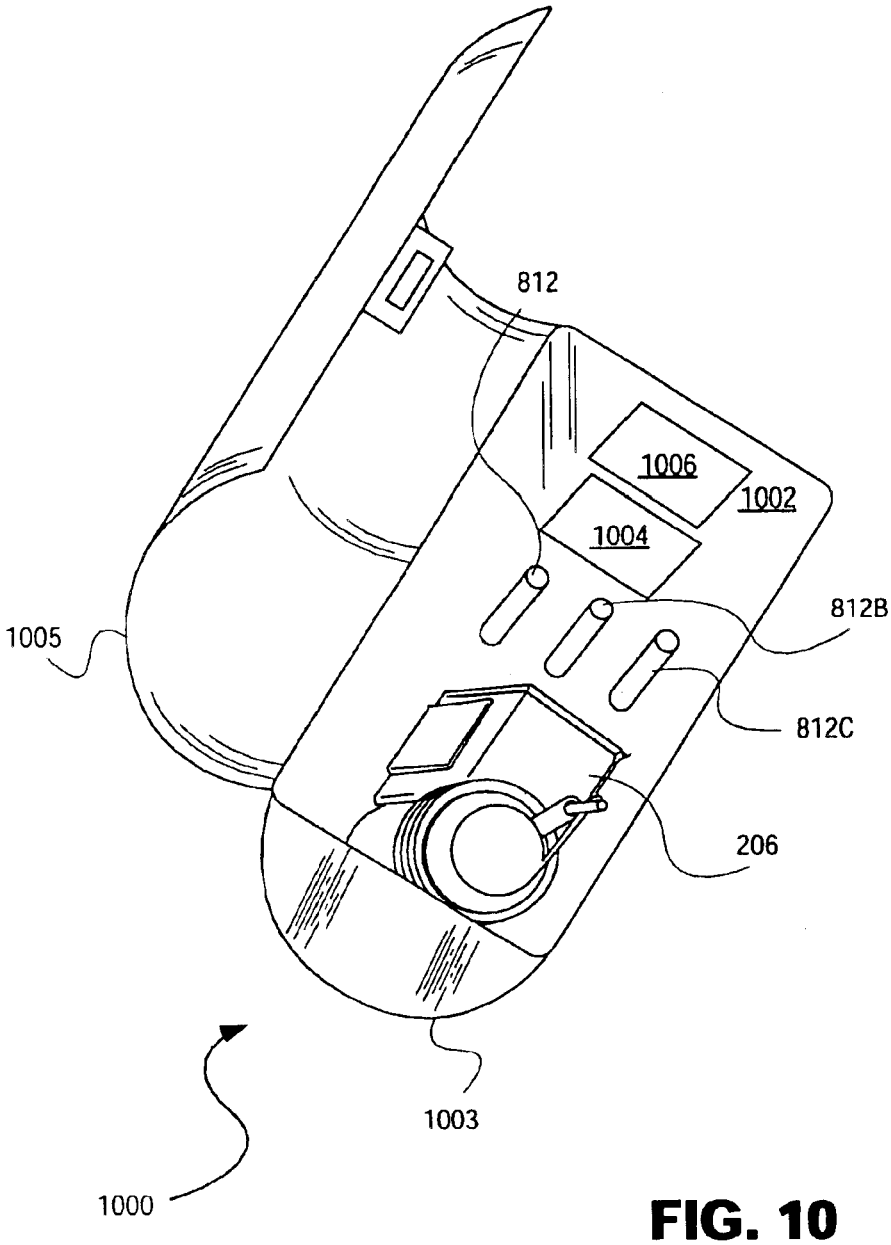
FIG. 10 is a diagram of a maintenance package for a portable printer according to an embodiment of the invention.

FIG. 10 shows a maintenance package 1000 that may be sold to consumers to supply and maintain a portable printer, such as the portable printer 102 as has been described herein. The package 1000 includes a case 1002, which may have a shape and size typical of that used for cases to store sun glasses. The case 1002 has an open position, as shown in FIG. 10, and a closed position. A bottom part 1003 is able to snap shut with a top part 1005 of the case in a substantially airtight manner.

The package 1000 includes a replacement carriage assembly 206. Alternatively, the package 1000 may only include a replacement carriage 602 with the print head 604 located on the bottom surface thereof, or only a replacement print head 604, where the replacement carriage 602 and the replacement print head 604 are not specifically shown in FIG. 10. The package 1000 also includes replacement fluid capsules 812, 8126, and 812C. There may be one capsule for each color fluid and two capsules of black fluid, or another configuration.

The portable printer for which the package 1000 is intended may be hand primed and serviced. Print heads may clog and may get fluid on the user. The user seating fluid capsules in the wells of the carriage assembly performs priming. The user also cleans extra fluid forced out of the nozzles or spent fluid capsules. Therefore, the package 1000 also includes wipes 1004 and/or 1006. The wipes 1004 are for the user to clean the print head after service, whereas the wipes 1006 are for the user to clean him or herself after servicing the printer. The wipes 1006 includes dye reducer to aid in this self-cleaning.

The carriage assembly 206 may be stored in the case 1002 until the user desires to use the portable printer for printing. The assembly 206 is removed at such time from the case 1002, loaded with fluid capsules, attached to the rail unit on the inside top cover of the printer, and attached to a power connect where necessary. Paper is positioned on the inside bottom cover of the printer, such that the paper remains stationary in this position during printer. The top cover of the printer is placed down over the bottom cover of the printer, and the printer is positioned appropriately on a docking station for power and control. Once printing is finished, the carriage assembly 206 may be disconnected from power, disconnected from the rail unit, and returned to the case 1002.

Conclusion

Embodiments of the invention provide for advantages not found within the prior art. Unlike existing mobile printers, the inventive mobile printers do not require a media feeder or rollers to feed media into the printer. Vertical movement over the media is achieved by the print head itself, instead of by having the media moved vertically to a new position under the print head. This means that fewer parts are typically needed, which saves space and conserves power, enabling the printer to more easily run off battery power as compared to existing mobile printers.

It is noted that, although specific embodiments have been illustrated and described herein, it will be appreciated by those of ordinary skill in the art that any arrangement is calculated to achieve the same purpose may be substituted for the specific embodiments shown. For example, other applications and uses of embodiments of the invention, besides those described herein, are amenable to at least some embodiments. This application is intended to cover any adaptations or variations of the present invention. Therefore, it is manifestly intended that this invention be limited only by the claims and equivalents thereof.

We claim:

1. A portable printer comprising:

a top cover having an inside surface;

a bottom cover having an inside surface on which a sheet is positionable;

one or more rail units disposed on the inside surface of the top cover; and, a carriage assembly movably connected to the one or more rail units such that the carriage assembly is able to move horizontally and vertically over the sheet, and print on substantially any part of the sheet, without movement of the sheet.

2. The portable printer of claim 1, wherein the carriage assembly comprises:

a carriage unit;

a print head disposed on a bottom surface of the carriage unit;

a motor coupled to the carriage unit to move the carriage assembly horizontally; and, a mechanism coupled to the carriage unit to move the carriage assembly vertically.

3. The portable printer of claim 2, wherein the print head is an inkjet-type print head, and the carriage assembly further comprises one or more wells in which corresponding ink capsules are insertable.

4. The portable printer of claim 2, wherein the motor is a worm-gear motor.

5. The portable printer of claim 2, wherein the mechanism comprises:

a watch-spring catch mechanism that winds to store sufficient energy to move the carriage assembly vertically; and, a drag-engage mechanism that winds the watch-spring catch mechanism as the carriage assembly horizontally approaches an end of the portable printer.

6. The portable printer of claim 1, wherein each of the one or more rail units has a plurality of gear teeth to engage the carriage assembly.

7. The portable printer of claim 1, wherein the one or more rail units comprises a fixed rail unit and at least one movable rail unit, each of the at least one movable rail unit situated to a side of the fixed rail unit, such that the carriage assembly moves over the sheet horizontally substantially via the fixed rail unit and moves over the sheet vertically substantially via the at least one movable rail unit.

8. The portable printer of claim 7, wherein each of the at least one movable rail unit comprises a wire leaf spring to maintain alignment with the fixed rail unit.

9. The portable printer of claim 1, wherein the one or more rail units essentially consists of a fixed rail unit.

10. The portable printer of claim 1, wherein the portable printer is removably attachable to a docking station storing one or more batteries to power the portable printer.

11. A printer comprising:

a top cover having an inside surface;

a bottom cover having an inside surface on which a sheet is positionable;

one or more rail units disposed on the inside surface of the top cover; and, a carriage assembly movably connected to the one or more rail units such that the carriage assembly is able to move horizontally and vertically over the sheet, and print on substantially any part of the sheet, without movement of the sheet, the carriage assembly having a single print head.

12. The printer of claim 11, wherein the carriage assembly comprises:

a carriage unit having a bottom surface on which the single print head is disposed;

a motor coupled to the carriage unit to move the carriage assembly horizontally; and, a mechanism coupled to the carriage unit to move the carriage assembly vertically.

13. The printer of claim 12, wherein the single print head is an inkjet-type print head, and the carriage assembly further comprises one or more wells in which corresponding ink capsules are insertable.

14. The printer of claim 12, wherein the motor is a worm-gear motor.

15. The printer of claim 12, wherein the mechanism comprises:

a watch-spring catch mechanism that winds to store sufficient energy to move the carriage assembly vertically; and, a drag-engage mechanism that winds the watch-spring catch mechanism as the carriage assembly horizontally approaches an end of the portable printer.

16. The printer of claim 11, wherein each of the one or more rail units has a plurality of gear teeth to engage the carriage assembly.

17. The printer of claim 11, wherein the one or more rail units comprises a fixed rail unit and at least one movable rail unit, each of the at least one movable rail unit situated to a side of the fixed rail unit, such that the carriage assembly moves over the sheet horizontally substantially via the fixed rail unit and moves over the sheet vertically substantially via the at least one movable rail unit.

18. The printer of claim 17, wherein each of the at least one movable rail unit comprises a wire leaf spring to maintain alignment with the fixed rail unit.

19. The printer of claim 11, wherein the one or more rail units essentially consists of a fixed rail unit.

20. The printer of claim 11, wherein the printer is a portable printer and is removably attached to a docking station storing one or more batteries to power the portable printer.

* * * * *